United States Patent [19]

Hallam

[11] 4,035,990

[45] July 19, 1977

[54] WRAPPING MACHINE

[75] Inventor: Harry Hallam, Coventry, England

[73] Assignee: A Campton & Sons Company Limited, Coventry, England

[21] Appl. No.: 645,899

[22] Filed: Dec. 31, 1975

[30] Foreign Application Priority Data

Jan. 8, 1975 United Kingdom ..... 712/75

[51] Int. Cl.[2] ..... B65B 11/06

[52] U.S. Cl. ..... 53/222; 53/228

[58] Field of Search ..... 53/222, 223, 224, 226, 53/228, 229, 230, 231, 232; 294/81 R, 88; 74/29, 422

[56] References Cited

U.S. PATENT DOCUMENTS

| | | | |
|---|---|---|---|
| 1,606,040 | 11/1926 | Paridon | 53/230 X |
| 1,816,085 | 7/1931 | Langhammer | 53/231 |
| 2,744,370 | 5/1956 | Seragnoli | 53/228 |
| 2,886,197 | 5/1959 | Harris | 294/88 X |
| 3,094,007 | 6/1963 | Luhrs | 74/422 |
| 3,605,380 | 9/1971 | Dille | 53/230 X |
| 3,643,397 | 2/1972 | Bahnsen | 53/182 X |
| 3,656,364 | 4/1972 | Cable et al. | 74/422 |
| 3,662,513 | 5/1972 | Fabbri | 53/226 X |
| 3,670,912 | 6/1972 | Dunbar | 294/88 X |
| 3,977,158 | 8/1976 | Jennings | 53/184 R |

*Primary Examiner*—Travis S. McGehee
*Assistant Examiner*—John Sipos
*Attorney, Agent, or Firm*—Gifford, Chandler, Sheridan & Sprinkle

[57] ABSTRACT

A wrapping machine for wrapping articles in stretchable material utilizes a lifting platform to lift articles into a sheet of the material. While holding the edges of the sheet, the wrapping operation takes place to stretch the sheet around the article and fold the edges under the article. During the wrapping operation, the article is held in place by arms gripping the sides of the article and, after wrapping, the article is discharged by movement of the article gripper. In addition the lifting platform is of special three part construction for maximum support to the article during wrapping, and the sheets are fed from a roll of material resting on a driven roller.

3 Claims, 7 Drawing Figures

WRAPPING MACHINE

BACKGROUND OF THE INVENTION

1. Field of The Invention

This invention relates to a wrapping machine of the kind in which articles are wrapped in sheets of stretchable material, in particular stretchable plastics film material.

2. Prior Art

The invention is particularly, but not exclusively, intended to provide improvements and modifications to the wrapping machine described in prior patent specification No. 397,144, now U.S. Pat. No. 3,977,158 in which there is described a machine by which articles can be automatically wrapped in sheets of a stretchable plastic material by feeding articles to be wrapped to a lifting table, lifting the article into a sheet of material while the edges of the sheet are held to thereby stretch the sheet, wrapping the sheet under the article with wrapping blades, and discharging the wrapped article and sealing the edges under the article.

SUMMARY OF THE INVENTION

An object of the invention is to provide a wrapping machine of the kind described in which various aspects of the machine are modified and improved.

According to the invention, a wrapping machine for wrapping articles in stretchable sheet material, comprises article feed means for feeding articles to a wrapping station, film feed means for feeding predetermined lengths of stretchable film to the wrapping station, holding means for holding the edges of the lengths of film at the wrapping station during the wrapping operation, a wrapping mechanism for wrapping the edges of said predetermined lengths of the film under the articles at the wrapping station, and reciprocable gripping means for gripping the articles during the wrapping operation and for discharging the wrapped articles from the wrapping station.

Preferably the gripping means includes gripping arms movable in opposite directions to engage opposite sides of the articles at the commencement of the wrapping operation. The arms may each be moved by a ram, the rams being operated in synchronism. The relative positions of the rams are conveniently adjustable to vary the spacing between the gripping arms in their non-engaging position in order to cater to articles of different sizes. By this arrangement the strokes of the rams can be fixed and the discharge means can still deal with articles of different sizes by adjustment of the initial spacing of the arms prior to a wrapping operation.

The film feed means may include a film storage roll supported on a drivable roller which is driven to assist in unrolling film from the roll.

Preferably drive to the drivable roller is derived from movement of a reciprocable carriage by which the material is carried to a wrapping station at which the articles are wrapped.

The article feed means may include a platform on which the articles are lifted into the lengths of film, the platform comprising a three part plate having a central part and lateral parts extending from opposite sides of the central part, the lateral parts being movable towards and away from one another and vertically relative to the central part during a wrapping operation.

The lifting platform is intended to give the necessary support to the article during each stage of the wrapping operation. During the initial stage as the article is pushed upwards into the length of film the whole undersurface of the article is supported by the three-part plate, the lateral parts being in their laterally-extended position. As the wrapping blades move under the article the lateral parts are moved towards the central part and are then moved downwards relative to the central part which continues to provide support to the article until the blades approach the central part at which time the central part is moved downwardly with the lateral parts to a position for receiving a further article.

BRIEF DESCRIPTION OF THE DRAWINGS

Further features of the invention will appear from the following description of an embodiment of the invention given by way of example only and with reference to the drawings in which.

DETAILED DESCRIPTION OF THE DRAWINGS

The illustrated wrapping machine for wrapping articles in sheets of stretchable film is in many respects similar to the machine described in said prior patent specification and reference should be made to this specification for a full understanding of those aspects of the machine not described herein.

Figure 1:
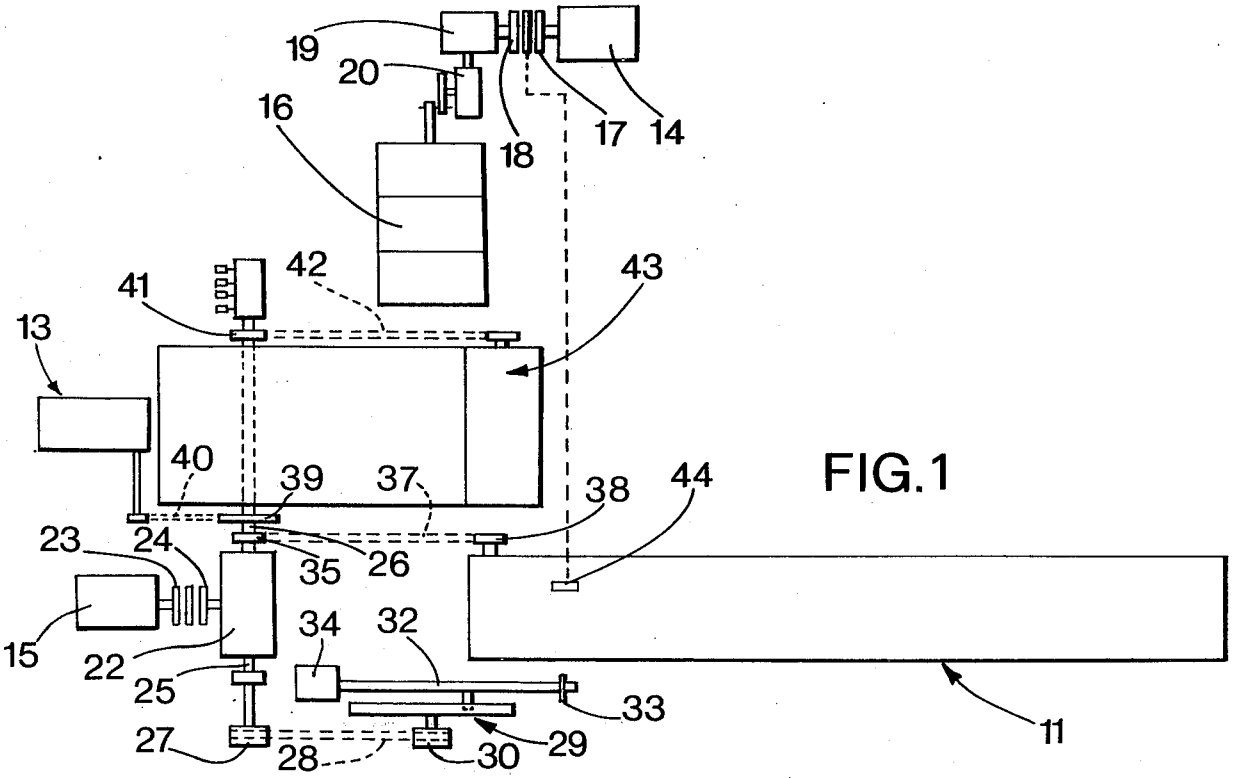
FIG. 1 is a schematic view of a wrapping machine according to the invention.

Referring to the drawings and firstly to FIG. 1 a wrapping machine is housed in a frame (not shown) and is arranged to wrap articles to be displayed in shops. A wide range of articles such as meat, vegetables and fruit can be wrapped by the machine and the machine is capable of wrapping articles having a wide range of sizes both in height and width.

Figure 6:
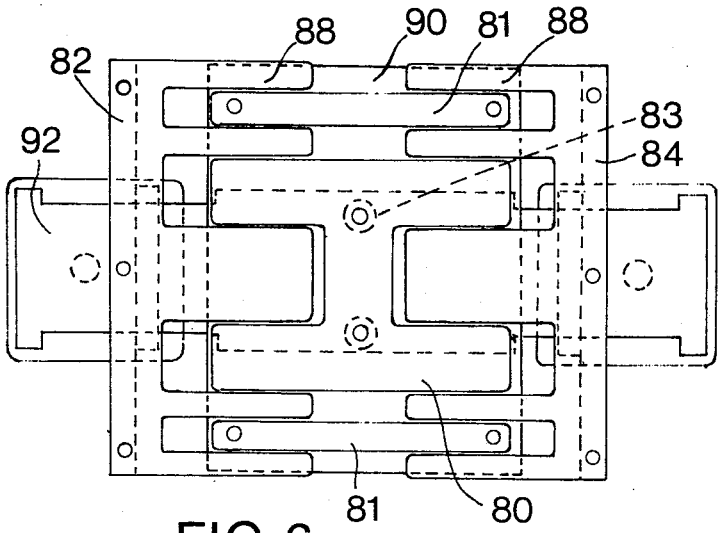
FIG. 6 is a plan view of the platform of FIGS. 3 and 4 in another position.

The articles are placed on a tray 10 (see FIG. 6) of known form and the tray and articles are manually or otherwise placed on a feed conveyor 11 in the form of a chain conveyor. The conveyor 11 carries the trays into the machine and a sheet of transparent film is located over the product on the tray and the edges are folded under the tray to be secured by applying heat to fuse the overlapped edges of the film. This latter sealing operation is carried out on a sealing conveyor 13 extending from the opposite side of the machine to the conveyor 11.

The film used in the wrapping operation is of the kind known as stretch film which is located over the tray and the product carried thereby and tension is applied to the film as the edges are drawn under the tray.

The machine is provided with two drive motors, one 14 of which is for feeding the required amount of film for wrapping the articles, hereinafter referred to as the film feed motor, and the other 15 of which is for driving all the remaining powered mechanisms embodied in the machine and is hereinafter referred to as the main drive motor.

The various mechanisms driven by the motors 14 and 15 are only shown in simplified form and diagrammatically in FIG. 1 and further reference should be made to FIGS. 2 to 7 and the description for an understanding of those mechanisms forming the subject of the present application and to said prior Patent Specification for the other mechanisms.

The film feed motor 14 drives a film feed mechanism 16 through a transmission including a clutch 17, a brake 18, a speed reduction unit 19 and a crank unit 20, the crank unit 20 converting the rotary motion of the motor 14 into a reciprocating motion by which the feed mechanism 16 (more fully described in said prior Patent Specification) is driven. The film feed means generally comprises two pairs of conveyor belts (not shown) movable over guide and drive rollers which are carried on a frame movable reciprocally over an adjustable distance. The drive rollers are connected to a rack so that upon relative movement between the frame and the rack the drive rollers rotate to draw the film between the conveyor belts and off a film storage roll. The action of the film feed mechanism is to draw out film from a roll of film 50 (FIG. 2) and feed it in predetermined lengths to a wrapping station.

The main drive motor 15 is operated continuously during normal operation of the machine and drives a speed reduction unit 22 through a clutch 23, a brake 24 and a torque control unit (not shown). Drive shafts 25 and 26 extend from opposite ends of the unit 22 and the shaft 25 carries a pulley 27 about which extends a drive belt 28 which transmits drive to a lifting arm drive mechanism 29 through a pulley 30. The mechanism 29 is described more fully in said prior Patent Specification and transmits a reciprocal pivoting movement to a lifting arm 32, having a pivotal mounting 33 at one end and carrying a lifting platform 34 at the opposite end. The lifting platform 34 is arranged to engage the underside of the trays to lift them through an apertured plate 21 (FIG. 7) into position for the wrapping operation. Such position is termed the wrapping station.

The shaft 26 is a lay shaft which carries a pulley 35 around which extends a drive belt 37 transmitting drive to a drive shaft 38 of the feed conveyor 11. The shaft 26 also carries a pulley 39 for a drive belt 40 which drives a drive shaft of the discharge conveyor 13.

A further pulley 41 on the shaft 26 has a drive belt 42 which drives a wrapping mechanism 43 for wrapping the film around the articles. This mechanism 43 is more fully described in said prior Patent Specification, but the mechanism includes two pairs of reciprocable wrapping blades 12 (FIG. 7), the blades of each pair moving in opposite directions to one another and transversely to the blades of the other pair and the blades 12 being arranged to engage the film and move its edges under the articles as described in our said prior specification. The film length is clamped along its edges by clamps, as indicated at X in FIG. 7, during the operation of the wrapping blades so that the film is stretched over the articles on the tray 10.

The use of the main motor 15 for all the machine functions except the film feed mechanism ensures that all such functions are always in synchronism without the need for additional control units. The operation of the feed motor 14 independently of the other machine functions ensures that film is only fed as and when it is needed and this is achieved by having a detector 44, of any convenient kind such as photo-electric cell, which actuates operation of the motor 14 when a tray is detected on the feed conveyor 11.

The torque control unit is provided to operate to disconnect drive from the motor 15 should the wrapping mechanism become jammed during operation.

It has been found that with the film feed means described in said prior specification problems sometimes arise due to static electricity stored in the film and to undue tension being imparted to the film as it is drawn off the storage roll.

Figure 2:
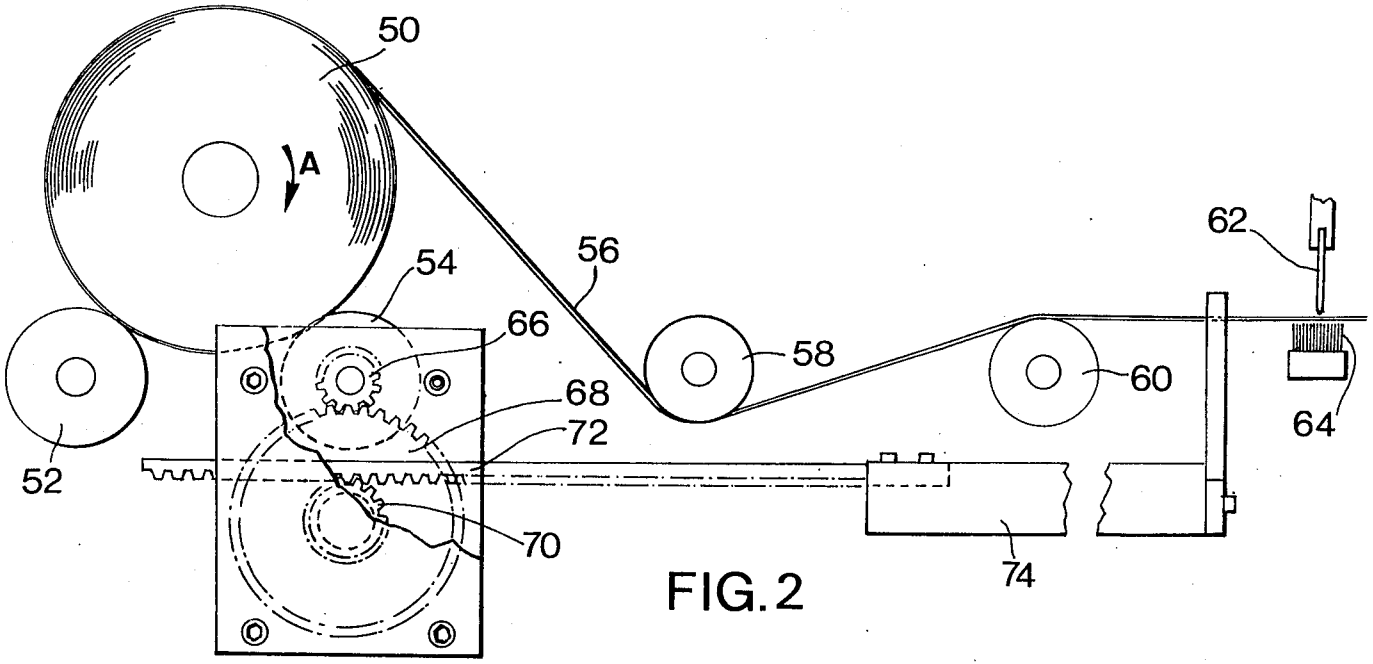
FIG. 2 is a side elevation of part of a feeding device for feeding wrapping material in the apparatus of FIG. 1.

Referring to FIG. 2 film is stored on a roll 50 supported at its radially outer periphery on an idler roller 52 and a driven roller 54 each extending the length of the roll 50. Film 56 is unwound from the side of the roll 50 so that as it unwinds, the roll 50 rotates in the direction shown by the arrow A.

The driven roller 54 assists in rotating the roll 50 by rotating in the opposite sense to the roll 50 and the film 56 passes under the roller 58 to a further supporting roller 60. After passing over the roller 60 the film 56 is perforated transversely of the direction of travel of the film and at spacings determined by the desired length of sheet for the wrapping operation. The perforations are formed by a perforator 62 movable towards and away from the film 56 and in the direction of movement of the film to perforate the film while it is being fed from the roll 50. The film 56 is supported during the perforating action by a transverse row of brushes 64.

The drive roller 54 is rotated in one direction only by a rack and pinion mechanism including a gear wheel 66 secured coaxially to one end of the roller 54 and meshing with a gear wheel 68. A further gear wheel 70 is coaxial with the gear wheel 68 and is connected thereto by a unidirectional coupling (not shown). The gear wheel 70 is engaged by a rack 72 which is carried on a bar 74 and is reciprocally movable by connection to the frame (not shown) on which the film guide and drive rollers are mounted, as described above. Thus as the frame is reciprocated to draw off lengths of film and feed them to the wrapping station, the rack 72 reciprocates and drives the roller 54. The driving of the roller 54 assists in unwinding the film from the roll 50 by rotating the roll during the drawing off of film.

As described above the film is fed by the film feed means to the wrapping station as a length which is still attached to the film on the roll 50 at the perforations. The length of film is positioned under a plate 21 (FIG. 7) having an opening 31 through which an article to be wrapped is pushed. At this time the article is supported on the lifting platform 34 onto which it is delivered by the feed conveyor 11 when the platform 34 is in a lowered position. The lifting platform is of special form to enable the article to be adequately supported during the wrapping operation and an improved form of lifting platform is shown in FIGS. 3, 4, 5 and 6 to which we now refer.

The platform comprises a three-part supporting plate having a central part 80 and laterally-extending parts 82 and 84 on opposite sides of the part 80. Each of the lateral parts 82 is formed with a central finger 86 being flanked by two pairs of relatively narrower fingers 88, and the fingers 86 engage with corresponding openings in the central part 80 when the plate is in the position shown in FIG. 6.

The central part 80 is flanked by support plates 81 and the plates 81 are mounted on a support plate 90 which in turn is connected to a mounting and guide plate 92. The lateral parts 82 and 84 are each attached to a support bar 94 on which is carried a guide bar 95 guided on the guide plate 92. The support plate 90 is formed with two pairs of bores 97 constituting cylinders for piston rods 96 secured to the support bars 94. Compressed air is led to the bores via an air pipe 93 to extend the piston rods 96 from the bores and thereby cause the lateral parts to adopt the position shown in FIG. 4.

The guide plate 92 is secured to the upper ends of piston rods 98 extending from cylinders 100 and the plate 92 and thus the support plates 90, the lateral parts 82 and 84 and the plates 81 are movable vertically reciprocally on operation of double-acting piston and cylinders constituted by the cylinders 100, piston rods 98 and their associated pistons.

The central part 80 of the supporting plate is supported on guide bars 83 which are fixed at their lower ends to a plate 99 secured rigidly to the cylinders 100 and at their upper ends to the part 40 and which bars 83 pass slidably through the support plate 90 and the guide plate 92.

The whole assembly of support plates and pistons and cylinders is mounted on the lifting mechanism through the plate 99 by which the supporting plates with the article to be wrapped supported thereon is pushed up into a length of film and the plate is subsequently moved downwardly as the wrapping operation proceeds. Such lifting mechanism is conveniently of the form described in said prior patent specification.

Figures 3, 4:
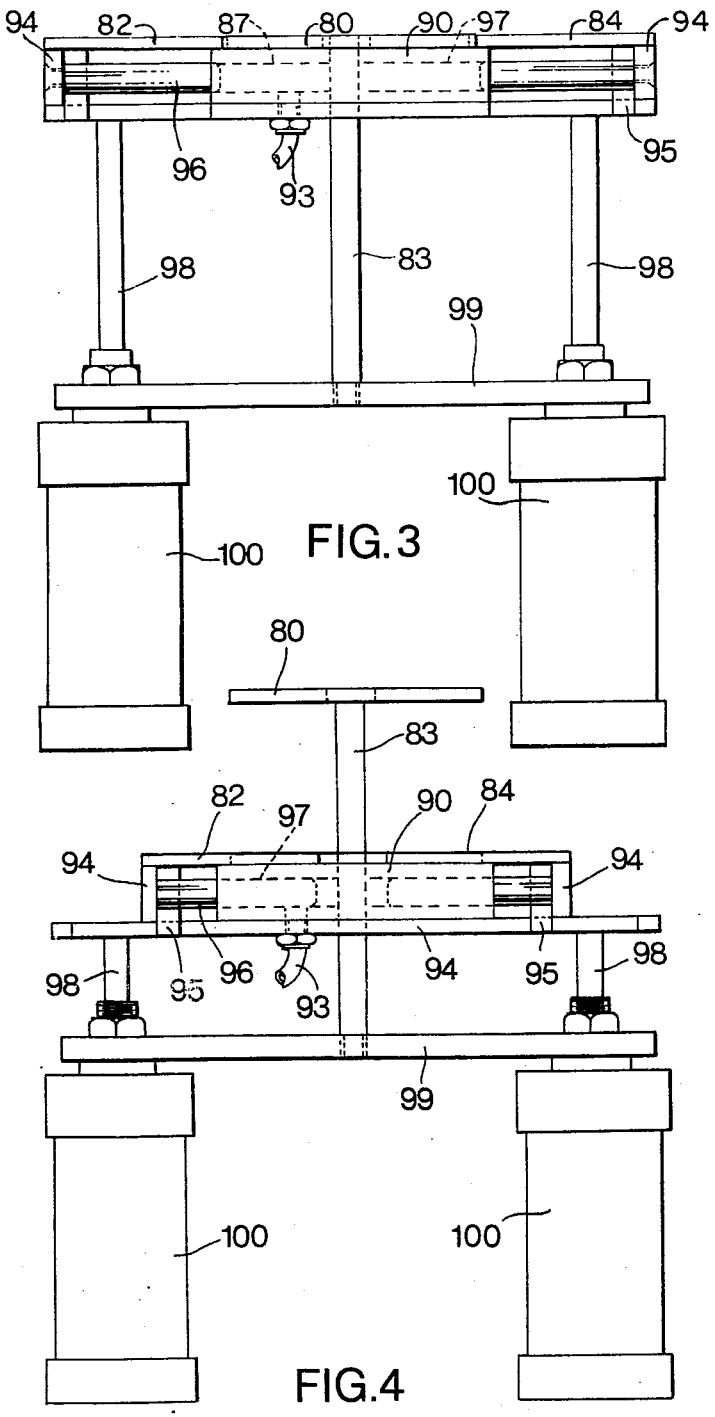
FIG. 3 is a side elevation of a support platform of the apparatus of FIG. 1, in one position.
FIG. 4 is a side elevation of the platform of FIG. 3 in another position.
Figure 5:
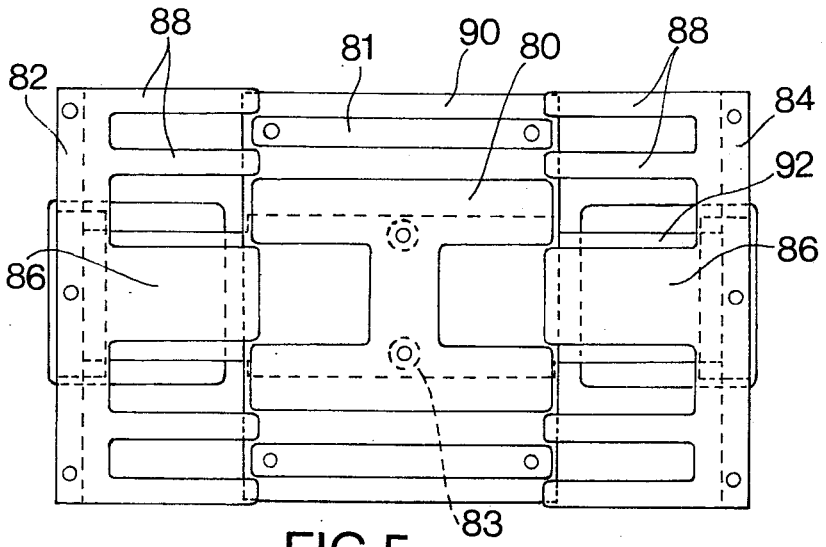
FIG. 5 is a plan view of the platform of FIGS. 3 and 4 in one position.

Operation of the lifting platform is as follows: Starting at the point at which the platform is fed with an article to be wrapped, the plate parts 80, 82 and 84 are in the position shown in FIG. 5, that is with the maximum effective supporting area for the base of the article. The lifting mechanism is operated to move the platform from the article receiving position upwards so that the article is pushed into a length of film whose edges are clamped, to thereby stretch the film. The wrapping blades 12, (FIG. 7) of the form described in said prior patent specification, are then operated to move the edges of the film under the article. In order to support the article fully during the wrapping operation as the blades move under the articles the lateral parts 82, 84 of the platform are moved towards the central part 80 by contact with the transverse wrapping blades as the blades 12 move under the article 10. In moving inwards the piston rods 96 are fully retracted into the bores, the parts 82, 84 are in the position shown in FIG. 6 and the piston rods 98 are retracted into the cylinders 100 to lower the parts 82 and 84 simultaneously away from the base of the article, to leave the article supported only by the central part 80 and by the wrapping blades, as shown in FIG. 4. As the blades near the center of the article, the lifting mechanism moves the whole lifting platform assembly downwardly and the wrapping blades take over fully the supporting function of the platform as they move the edges of the film into an over-lapped condition under the article.

Before a further article is received on the lifting platform the piston rods 96 and 98 are extended from their respective cylinders so that the parts 80, 82 and 84 are in their raised position in the same plane as the part 40 and the parts 82 and 84 are in their laterally-extended position of FIG. 4. The cycle described is then repeated for subsequent articles.

After the length of film is folded with its edges under the article, the wrapped article is discharged from the wrapping station. In order to achieve discharge the pusher blade described in said prior patent specification is replaced by the mechanism shown in FIG. 7 to which we now refer.

The discharge mechanism is mounted on the pusher drive mechanism described in said prior patent specification so as to be bodily reciprocally movable towards the discharge conveyor 13. Attachment to the pusher drive mechanism is through a plate 102 which is attached to an end plate 104 through guide bars 106 and 108. A pair of gripping arms for gripping the articles 10 during discharge are mounted for movement along the guide bars 106 and 108 and the gripping arms each include a gripper plate 110, which engages the article, mounted on a support arm 112 guided on the bars 106 and 108. A further plate 114 is attached to a cylinder of a piston and cylinder 118 and the arm 112 is attached to the piston rod of the piston and cylinder 118. The plate 114 is guided for movement along the guide bars 106 and the cylinder of the piston and cylinder 118 is also attached to a plate 120 guided for movement along the other guide bar 108.

The gripping arms 110, 112 and associated pistons and cylinders are disposed symmetrically about and at adjustable distances from an adjustment mechanism including a rack and pinion mechanism. Such mechanism has two oppositely-facing racks 122 and 124 each attached to their respective plates 114 and both racks are engaged by a pinion 126 carried on the end of a spindle 128 whose upper end carries an adjustment knob 130. The pinion 126, spindle 128 and knob 130 are mounted by means of a support plate 132 on a support member secured midway along the guide bar 106 and rotation of the pinion 126 causes the racks 122 and 124 to be moved in opposite directions to draw together or space apart the gripping arms. The pinion 126 is normally locked against such movement by a pin (not shown) engaging in holes in the underside of the pinion, and the pinion 126 can only be turned when the knob 130 and spindle 128 are lifted against the action of a spring 134 to release the pin from the respective hole in the pinion 126.

The adjustment mechanism enables the spacing of the gripping arms to be adjusted according to the size of article being wrapped. For example if the article 10 is relatively large then the initial spacing of the gripping arms is adjusted so as to be relatively wide. In this way the stroke of the piston and cylinders 118 need only be relatively small and fixed irrespective of the size of the article.

Figure 7:
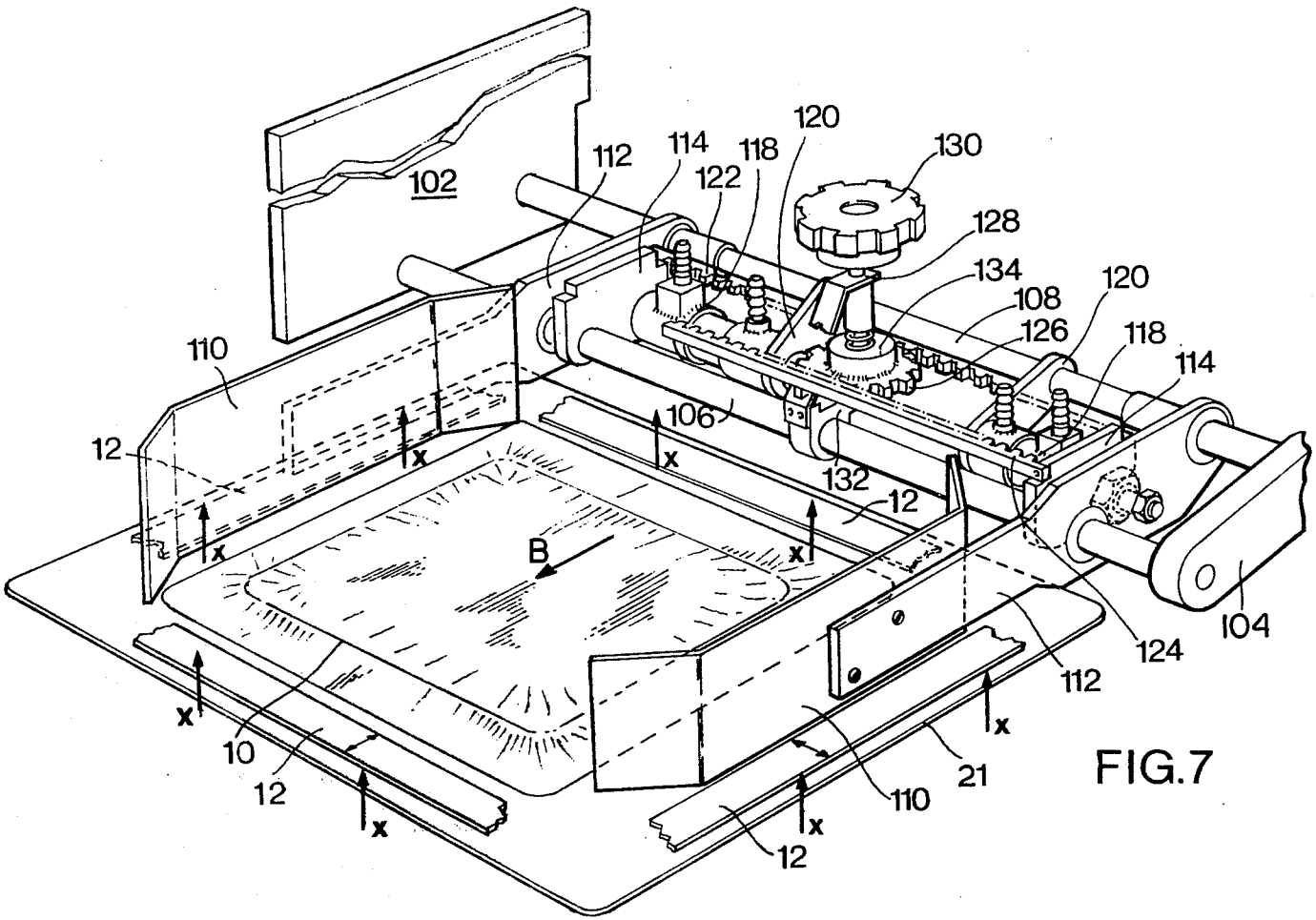
FIG. 7 is a perspective view of a gripping device for wrapping articles for the apparatus of FIG. 1.

In operation the plates 110 are located to the sides of the article 10 which lie parallel to the direction of discharge, as indicated by the arrow B, and above the apertured plate 21, and before commencement of the wrapping operation but after an article has been pushed into a film length through the aperture 31, the piston and cylinders 118 are operated from the non-gripping position shown in FIG. 7 to retract and move the plates 110 towards one another and engage the sides of the article 10 and thereby grip the article between them. The wrapping operation of the wrapping blades 12 then takes place with the article held by the arms and the edge of the film length clamped at X until the blades have moved the film under the article. After completion of the wrapping operation the whole of the gripping arm assembly is moved bodily forward in the direction B to discharge the article from the wrapping station onto the discharge conveyor 13. When the article has reached the discharge conveyor 13 the piston and cylinders 118 are extended to release the article for discharge and sealing of the overlapped edges of the film onto the underside of the article. The assembly is then returned to the wrapping station for a further wrapping operation to commence.

Drive for the piston and cylinders of the lifting platform and the gripping arms is preferably pneumatically powered and the compressed air for this purpose is conveniently generated by a separately driven compressor.

What I claim as my invention and desire to secure by Letters Patent of the United States is:

1. A wrapping machine for wrapping articles in stretchable sheet material, comprising article feed means for feeding articles to a wrapping station, the article feed means including a lifting platform on which the articles are lifted into the stretchable sheet material, feed means for feeding predetermined lengths of the stretchable sheet material to the wrapping station, holding means for holding the edges of the lengths of material at the wrapping station during the wrapping operation, a wrapping mechanism for wrapping the edges of the lengths of material under the articles at the wrapping station, and reciprocable gripping means for gripping the articles during the wrapping operation and for discharging the wrapped articles from the wrapping station, the lifting platform comprising a three part plate having a central part and lateral parts extending from opposite sides of the central part, the lateral parts being movable towards and away from one another and vertically relative to the central part during a wrapping operation.

2. A machine according to claim 1 wherein the central and lateral parts of the plate lie in a common plane during the initial part of the wrapping operation, the lateral parts being moved towards one another and into overlapping relationship with the central part prior to said relative vertical movement.

3. A machine according to claim 1 wherein the lateral parts of the platform are engaged by the wrapping mechanism during the wrapping operation to move the lateral parts towards one another.

* * * * *